United States Patent [19]

Rentler et al.

[11] 4,404,008

[45] Sep. 13, 1983

[54] COMBINED CASCADE AND MULTICOMPONENT REFRIGERATION METHOD WITH REFRIGERANT INTERCOOLING

[75] Inventors: Robert J. Rentler, Macungie, Pa.; David D. Sproul, Houston, Tex.

[73] Assignee: Air Products and Chemicals, Inc., Allentown, Pa.

[21] Appl. No.: 349,786

[22] Filed: Feb. 18, 1982

[51] Int. Cl.[3] ..... F25J 3/02

[52] U.S. Cl. ..... 62/11; 62/40

[58] Field of Search ..... 62/40, 9, 11, 36

[56] References Cited

U.S. PATENT DOCUMENTS 3,763,658 10/1973 Gaumer, Jr. et al. ..... 62/40

3,970,441 7/1976 Etzbach et al. ..... 62/40

*Primary Examiner*—Frank Sever

*Attorney, Agent, or Firm*—Geoffrey L. Chase; E. Eugene Simmons; James C. Simmons

[57] ABSTRACT

A method for cooling and liquefying a methane-rich gas stream, such as natural gas, is set forth wherein the methane-rich gas stream is heat exchanged against a single component refrigerant, such as propane, in a closed cycle and a multicomponent refrigerant, such as lower hydrocarbons, in another closed cycle in which the single component refrigerant is used to cool the multicomponent refrigerant subsequent to the multicomponent refrigerant's compression and between stages of its compression. The additional cooling between stages of compression shifts compression load from the multicomponent refrigeration cycle to the single component refrigeration cycle. This shift of compression load allows the load on the compression drivers on both cycles to be balanced. The ability to shift compression load is beneficial in cool ambient condition regions where the two cycles could be effected differentially.

7 Claims, 1 Drawing Figure

COMBINED CASCADE AND MULTICOMPONENT REFRIGERATION METHOD WITH REFRIGERANT INTERCOOLING

TECHNICAL FIELD

The present invention is directed to the refrigeration and liquefaction of methane-rich feed streams such as natural gas streams or synthesis gas streams. More specifically, the present invention is directed to a cascade refrigeration system wherein two separate refrigerant cycles are utilized to cool and liquefy the feed stream. The invention is also directed to the interstage cooling of one refrigeration cycle by the other refrigeration cycle.

BACKGROUND OF THE PRIOR ART

Refrigeration and liquefaction systems for the liquefaction of natural gas and other methane-rich gas streams are well known in the prior art. Cascade refrigeration systems using various multicomponent refrigerants have also been disclosed.

The prior art has also taught the combination of a cascade refrigeration system with a multicomponent refrigerant. For instance, in U.S. Pat. No. 3,763,658, a refrigeration and liquefaction system is set forth wherein a single component refrigerant and a multicomponent refrigerant are utilized in a cascade fashion to cool and liquefy a natural gas or methane-rich stream. It is disclosed to cool the multicomponent refrigerant with the single component refrigerant. In addition to the cooling of one refrigerant by the other refrigerant, the systems generally utilized ambient water found at the site of the liquefaction plant to aftercool the refrigerants during the compression of the same on the warm end of the refrigerant cycle.

Variations in the ambient temperature of such cooling water affects the demands on compressor drivers in the various refrigeration cycles and requires the selection of differing driver components depending upon those ambient conditions. This latter situation poses a problem for the matching of equipment parts and incurs a complexity and cost in the initial system and in the maintenance of replacement parts and the system as a whole.

BRIEF SUMMARY OF THE INVENTION

The present invention provides a method and system for cooling and liquefying a methane-rich gas stream which is at superatmospheric pressure wherein a cascade two refrigeration cycle system is utilized in which an initial refrigeration cycle including a single component refrigerant cools both the methane-rich gas stream and the second refrigeration cycle which comprises a multicomponent refrigerant. The multicomponent refrigerant cools and liquefies the initially cooled methane-rich gas stream coming from the single component refrigeration cycle. Both refrigeration cycles go through a recompression and aftercooling step in which the aftercooling is achieved by heat exchange with a cold water or non-hydrocarbon cooling fluid. This fluid is normally an ambient condition fluid and in instances where the ambient conditions are cold, the greater effectiveness in aftercooling the compressed single component refrigerant in distinction to the aftercooling of the multicomponent refrigerant creates an imbalance in the cooling load experienced by the drivers of the compressors in the two cycles. The present invention provides interstage cooling of the second refrigeration cycle by heat exchange with the first refrigeration cycle to cool the multicomponent refrigerant in the second cycle between stages of compression. This equalizes the cooling load and allows coresponding compressor driver equipment to be utilized in the compression stages of both refrigeration cycles. This allows for efficient operation of the refrigeration cycles and avoids the complexity of other balancing methods or the complexity of providing dissimilar compression equipment and replacement parts.

BRIEF DESCRIPTION OF THE DRAWINGS

The FIGURE of the drawings is a schematic flow diagram of the refrigeration system disclosing the preferred embodiment of operation of the present invention.

DETAILED DESCRIPTION OF THE INVENTION

Figure 1:
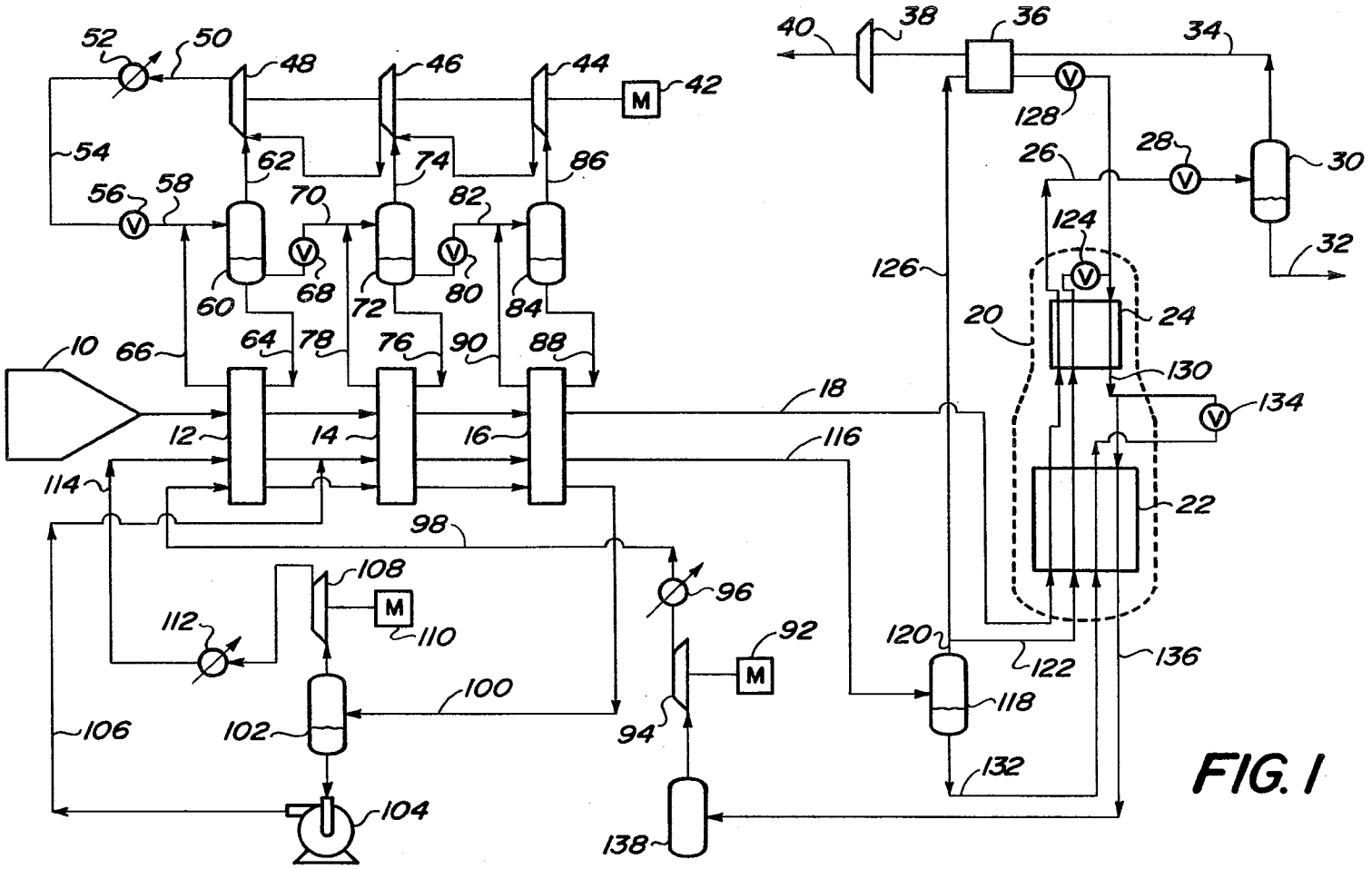

The system and process of the present invention will now be described in greater detail with reference to FIG. 1. A previously treated methane-rich gas stream such as natural gas which is free of moisture and carbon dioxide is introduced into the system of the present invention in line 10. The gas feed stream is preferably at a pressure of 815 psia and a temperature of 60° F. The feed stream is initially cooled in heat exchanger 12 wherein the cooling function is supplied by a single component refrigerant. The single component refrigerant is preferably propane, but other lower molecular weight hydrocarbons may be utilized such as ethane, propylene, butane or halogenated $C_{2-4}$ hydrocarbons. The feed gas stream in line 10 is cooled in exchanger 12. The feed gas stream then enters a second stage heat exchanger 14 where it is further cooled against a single component refrigerant in the same refrigeration cycle as that utilized in the first stage heat exchanger 12. The gas feed stream is then conducted to a third stage heat exchanger 16 which lowers the temperature of the stream to −34° F. This exchanger is also cooled by the single component refrigerant in the same refrigeration cycle as heat exchangers 12 and 14. At this point, the three stage cooled gas feed stream now in line 18 is at a pressure of 800 psia. The stream consists of over 90% methane.

The feed stream in line 18 is then conducted through a two stage main heat exchanger 20. In this main heat exchanger 20, the gas stream in line 18 is cooled and liquefied against a multicomponent refrigerant in a second refrigeration cycle separate from that of the single component refrigerant in the first refrigeration cycle described above. The feed stream enters a first stage exchanger unit 22 wherein it is cooled to approximately −198° F. The feed stream is then cooled in a second stage exchanger unit 24 where it is fully liquefied and cooled to a temperature of −248° F. The liquefied methane-rich stream in line 26 is then expanded through valve 28 before being separated into a gas phase and a liquid phase in separator vessel 30. The liquid phase at a temperature of −257° F. and a pressure of 18 psia is then conducted through line 32 to storage as a liquefied methane-rich material or natural gas. The vapor phase gas is then conducted through line 34 to recouperative heat exchanger 36 wherein the cooling power of the vapor stream is recovered in the multicomponent refrigerant. The rewarmed gaseous stream is then compressed in compressor 38 to an appropriate fuel gas pressure and exported from the system in line 40 at a temperature of 60° F. and a pressure of 450 psia.

The single component refrigerant which is utilized in the first refrigeration cycle incorporating heat exchangers 12, 14 and 16 is compressed in a three stage compressor which is operated by driver 42. This driver can comprise any motive force device such as an electric motor, a steam operated turbine or a gas turbine. Each stage of the three stage compressor compresses the vapor output of the three stage heat exchangers 12, 14 and 16 and the flash vapor from valves 56, 68 and 80. For example, single component refrigerant vapor produced from heat exchanger 16 and flash vapor from valve 80 is directed into a compressor 44 for compression to a pressure of 16 psia. This compressed stream is combined with vapor produced from heat exchanger 14 and flash vapor from valve 68 and is compressed in compressor 46 to a pressure of 39 psia. Likewise, the vapor developed from heat exchanger 12 and the flash vapor from valve 56 is combined with the compressed stream from compressor 46 and is further compressed in compressor 48. All of these compressors are driven by the driving unit 42. The combined compressed streams in line 50 are cooled against a cold water or non-hydrocarbon cooling fluid in heat exchanger 52. The single component refrigerant at this point is at a temperature of 60° F. and a pressure of 108 psia. The refrigerant is then recycled through line 54 and reduced in pressure and flashed in expansion valve 56 to a temperature of 24° F. and a pressure of 60 psia in line 58. The single component refrigerant is combined with a side stream of single component refrigerant which has already seen heat exchange duty in exchanger 12. The combined stream from line 58 and 66 is introduced into a separator vessel 60 wherein the gas phase and the liquid phase of the refrigerant are separated. A portion of the liquid phase of the single component refrigerant is removed from the bottom of the separator vessel 60 in line 64 wherein it is circulated through heat exchanger 12 to provide a cooling effect to the incoming stream in line 10. This is the first stage of a three stage cooling which is effected in the three stage heat exchangers 12, 14 and 16. The refrigerant in line 64 also functions to cool a multicomponent refrigerant in line 114 and 98 to be discussed below. The warmed refrigerant is then returned in its cycle in line 66. The vapor phase of the single component refrigerant is removed from the overhead of the separator vessel 60 in line 62 where it is compressed in compressor 48 along with refrigerant provided from the other stages of the multistage compressor.

A side stream of liquid refrigerant is removed from the separator vessel 60 and expanded in valve 68. This refrigerant side stream in line 70 is combined with a warmed refrigerant being recycled through return line 78. The combined streams are introduced into a second separator vessel 72 wherein the gas phase and the liquid phase are separated as occurred in separator vessel 60. A portion of the liquid phase of the single component refrigerant is removed from the separator vessel in line 76 to provide a cooling effect in heat exchanger 14 where the feed stream 10 is undergoing its second stage of cooling. The refrigerant in line 76 also performs a cooling function on a multicomponent refrigerant in lines 114 and 98 as discussed below. The warmed refrigerant is then returned from the second stage heat exchange 14 in line 78. The vapor phase of the single component refrigerant in separator vessel 72 is removed as an overhead stream in vapor return line 74 which introduces the vaporous refrigerant into the second stage compressor 46. Refrigerant compressed in compressor 46 is a combination of previously compressed refrigerant from the first stage compressor 44 as well as the vaporous refrigerant in line 74.

A side stream of liquid single component refrigerant is removed from separator vessel 72 and expanded in valve 80. The expanded refrigerant in line 82 is combined with a warmed refrigerant returned from the third stage heat exchanger 16 in return line 90. The combined stream is introduced into separator vessel 84. The refrigerant separates into a vapor phase and a liquid phase in this vessel 84. The liquid phase is removed in line 88 to provide a cooling effect in the third stage heat exchanger 16. The warmed single component refrigerant is then returned in return line 90. The vapor phase of the single component refrigerant in separator vessel 84 is removed in return line 86 to the first stage compressor 44. The compressed refrigerant is delivered to the second stage compressor 46 where it is combined with the vapor overhead from the separator vessel 72 and the thus compressed combined streams are delivered to the third stage compressor 48 where the vapor phase from separator vessel 60 is combined with the compressed refrigerant and is compressed to its highest pressure in the exit line 50.

All three stages of compression in the compressors 44, 46 and 48 are preferably powered by a single power source or motor 42 on a common axle or drive shaft. This motor may consist of an electric motor or a steam driven turbine or other power sources known to the art and utilized to provide input to the drive shaft of a compressor. Such a power source 42 is designed to be of a capacity to match the compression demands of all three stages of the compressors 44, 46 and 48. Peak efficiencies of the particular power source utilized are achieved only when the power source is used to compress the maximum compression load for which the system is designed. If the compression load is reduced, the system becomes less efficient in the power supplied for compression, or in the alternative, a scaled down or less powerfull power source 42 is incorporated into the system. In the circumstance where the heat exchanger 52 is provided with a cold water or non-hydrocarbon cooling fluid of particularly cold ambient condition, such as below 55° F., then the system may become less efficient in handling the resultant compression load unless a different power source is utilized or additional refrigeration load is provided for such that the additional cooling effect in heat exchanger 52 is offset. The purpose of the present embodiment of the second refrigeration cycle of this invention as described below is to achieve the above result, namely to shift refrigeration load from one refrigeration cycle to another refrigeration cycle to offset inefficiencies which develop from the utilization of unusually cold refrigerant such as in heat exchanger 52. More particularly, the goal is to shift refrigeration load from the multicomponent refrigeration cycle to the single component refrigeration cycle.

The cooling and liquefaction of the feed stream 10 through the flow stream of the present invention has been described, as well as the operation of the initial cooling effected by the single component refrigerant. The second cooling effect on the feed gas stream in its eventual liquefaction is performed by a second closed cycle refrigerant which is comprised of a multicomponent refrigerant. The multicomponent refrigerant may consist of any combination of components which efficiently cool the feed stream in the heat exchangers of the present system. However, in a preferred embodiment, the present system operates optimally with a multicomponent refrigerant mixture consisting of 4 to 6 components; namely, nitrogen, methane, ethane and propane. Butane, comprising a mixture of normal and iso forms, as well as pentane may also be included in the refrigerant. Additionally, the preferred compositional ranges of these components comprise 2–12 mole percent of nitrogen, 35–45 mole percent of methane, 32–42 mole percent of ethane, and 9–19 mole percent of propane. A specific multicomponent refrigerant which is optimal for a particular feed stream comprises approximately 10 mole percent of nitrogen, 40 mole percent of methane, 35 mole percent of ethane, and 15 mole percent of propane. The optimal refrigerant composition will vary depending on the particular feed stream composition being liquefied. However, the several variations of the multicomponent refrigerant composition will remain within the component ranges indicated above. Ethylene may replace ethane in the multicomponent refrigerant and propylene may replace propane.

The multicomponent refrigerant in its rewarmed state subsequent to utilization as a cooling refrigerant for the liquefaction of the feed stream 10 is returned to a first stage of compression which occurs in compressor 94. This compressor is driven by a motor or power source 92. The power source is matched to the compression load experienced in compressor 94. As discussed above for power source 42, the power source 92 is most efficient when the power capacity of the power source 92 is matched to the maximum compression load of compressor 94. The compressed multicomponent refrigerant is then aftercooled in heat exchanger 96 against a cold water or non-hydrocarbon cooling fluid. In the prior art, the compressed and aftercooled refrigerant would normally be sent to a subsequent stage of compression and aftercooling with a cold water or non-hydrocarbon cooling fluid. However, in the present invention and preferred embodiment, the initially compressed and aftercooled multicomponent refrigerant is directed in line 98 at a temperature of 60° F. and a pressure of 154 psia through the various stages of the heat exchangers 12, 14, and 16 to be cooled against the single component refrigerant. This cycling of the multicomponent refrigerant interstage of compression in line 98 against the single component refrigerant effects a transfer or shifting of the refrigeration load from the multicomponent refrigeration cycle to the single component refrigeration cycle. After being further cooled in the heat exchangers 12, 14 and 16, the multicomponent refrigerant in line 100 is then introduced into a separator vessel 102. The refrigerant is separated into a vapor phase and a liquid phase. The vapor phase is compressed in a compressor 108 which is driven by a motor or power source 110.

Again, the power source and the compressor are matched such that the power output of the power source 110 matches the compression load of the compressor 108. For design and maintenance efficiencies, the power sources 92 and 110 are matched with respect to power requirements and component configurations. For greatest design efficiencies and reduced cost factors with regard to maintenance, the power source 42 is also matched to these other power sources 92 and 110.

The compressed multicomponent refrigerant is aftercooled in heat exchanger 112 against cold water or non-hydrocarbon cooling fluid. The cooled and compressed refrigerant is then directed through line 114 to the first stage 12 of the heat exchangers 12, 14 and 16.

At the same time, the liquid phase of the interstage cooled multicomponent refrigerant in separator vessel 102 is directed through a liquid pump 104 which delivers the liquefied multicomponent refrigerant phase in line 106 to a point intermediate of the first stage 12 and the second stage 14 of the heat exchangers 12, 14 and 16. After the cooled and compressed vapor phase refrigerant is further cooled in heat exchanger 12, the stream in line 114 is combined with the liquid phase refrigerant in line 106. The combined refrigerant streams are further cooled in heat exchangers 14 and 16 against the propane refrigerant. The cooled and liquefied multicomponent refrigerant is delivered through line 116 into a phase separator 118. The vapor phase of the multicomponent refrigerant in separator vessel 118 is removed as an overhead stream in line 120. The stream is split into a major stream in line 122 and a minor slip stream in line 126. The vapor phase refrigerant major stream in line 122 is introduced into the liquefying and subcooling main heat exchanger 20. The major stream is initially cooled along with the feed stream in line 18 by heat exchange in the first stage 22 of the main heat exchanger 20 against stream 136. The feed stream in line 18 and the major stream in line 122 are further cooled by the refrigerant stream in line 130 in the second stage 24 of the heat exchanger 20. The minor multicomponent refrigerant slip stream in line 126 is liquefied in heat exchanger 36 against a methane-rich fuel stream which is rewarmed for immediate fuel use. This refrigerant is then expanded through valve 128 before combining with the major stream which is expanded through valve 124 and introduced into the second stage 24 of the main heat exchanger 20. This combined stream in the second stage 24 supplies the cooling effected in this stage. The warming refrigerant in line 130 is then combined with the expanded effluent from the liquid phase of the separator vessel 118. This liquid phase as it is removed from the separator vessel 118 in line 132 is cooled in the first stage 22 of the heat exchanger 20. The cooled liquid phase is then expanded in valve 134 before being combined with the refrigerant in line 130. The combined streams are passed through the first stage 22 of the main heat exchanger 20 to supply the cooling effect for the various streams in that stage which liquefy the feed stream in line 18. The rewarmed multicomponent refrigerant exits the main heat exchanger 20 in return line 136. The return line 136 delivers the rewarmed multicomponent refrigerant to a suction drum 138. This drum functions to safeguard that liquid phase is not introduced into the compressor 94. Under ordinary operation, liquid phase does not exist in line 136 or in drum 138. However, during poor operation or misoperation of the plant this drum effects a safety collection of any liquid which might develop under such conditions.

Although both the single component refrigerant cycle and the multicomponent refrigerant cycle of the present invention utilize aftercooling heat exchangers supplied by ambient cold water or non-hydrocarbon cooling fluid, the effect on the system of inordinately cold fluid entering these heat exchangers 52, 96 and 112 is more dramatically observed in the single component refrigerant cycle. This imbalance in observed effect of the reduced ambient temperature conditions of coolant in these heat exchangers exists because all of the aftercooling effect in the propane cycle is performed by the heat exchanger 52. However, in the multicomponent refrigerant cycle the aftercooling function is performed not only by the cold cooling fluid heat exchangers 96 and 112 but also by the three stage heat exchangers 12, 14 and 16 particularly with respect to the flow in lines 114–116. Therefore, for every increment of temperature decrease in the ambient cold cooling fluid utilized in the aftercooler heat exchangers 52, 96 and 112, a greater cooling and condensation effect is observed in the single component refrigerant cycle than is observed in the multicomponent refrigerant cycle.

The significant effect of a reduction in the ambient temperature of the cold water or non-hydrocarbon cooling fluid supplied to these heat exchangers 52, 96 and 112 is to offset the balance of the compression load experienced in the compressors 44, 46 and 48 with the maximum power available from the power source 42. An effect of equal magnitude is not experienced in the corresponding power sources 92 and 110 and compressors 94 and 108 of the multicomponent refrigerant cycle. Therefore, during operation of the system with decreased ambient temperature cold water or cooling fluid, the single component refrigerant cycle experiences either a decrease in efficiency of operation of power source 42 or the power source must be replaced with a component of lessor maximum power capacity. However, it is undesirable to operate such a liquefaction system with a multiplicity of power sources of differing capacity. Operators prefer systems in which a great degree of interchangeability in components exists. Of course, operation of such a system utilizing a power source which is not operating at peak efficiency is also detrimental and costly. Therefore, the present invention, by utilizing interstage cooling of the multicomponent refrigerant cycle against the single component refrigerant cycle to shift refrigeration load from the less severely effected cycle to the more severely effected cycle, achieves the goal of maintaining all of the power sources 42, 92 and 110 as equal power requirement components which are readily interchangeable and require fewer and more standardized replacement parts. The provision of an interstage cooling cycle in line 98 between the multicomponent refrigerant and the single component refrigerant allows this system to be utilized at maximum efficiency over a broader range of potential ambient conditions which might be experienced at different plant sites. Effectively the plant could be utilized in extremely cold ambient conditions such as exists in far northern latitudes or at highly elevated locations. The switching of refrigeration load from the multicomponent refrigerant cycle to the single component refrigeration cycle by the interstage cooling loop 98 provides a novel system for the retention of similar compression loads and power source components in the present liquefaction process and apparatus.

The above described flow scheme is understood to be a preferred embodiment, and it is within the scope of the present invention to use similar components such as the number of separate stages of compression in both refrigeration cycles. The scope of the present invention should be determined from the claims which follow.

We claim:

1. A method for cooling and liquefying a methane-rich gas stream which is at superatmospheric pressure comprising the steps of:

(a) initially cooling the methane-rich gas stream in a series of staged heat exchangers with a single component refrigerant, (b) cooling and partially liquefying a pressurized multicomponent refrigerant in a series of staged heat exchangers with said single component refrigerant, (c) separating the gas and liquid phases of the cooled multicomponent refrigerant, (d) liquefying and subcooling said methane-rich gas stream in a series of heat exchangers with the gas phase and the liquid phase of said multicomponent refrigerant, (e) recompressing said single component refrigerant in a series of staged compressions, (f) aftercooling said compressed single component refrigerant against a non-hydrocarbon cooling fluid, (g) initially recompressing said multicomponent refrigerant and aftercooling said refrigerant against a non-hydrocarbon cooling fluid, (h) interstage cooling of said multicomponent refrigerant in a series of heat exchangers against the single component refrigerant to form a two phase multicomponent stream, (i) compressing the gas phase of the multicomponent refrigerant and aftercooling the compressed refrigerant against a non-hydrocarbon cooling fluid before further cooling against the single component refrigerant, (j) pumping the liquid phase of the multicomponent refrigerant to a pressure equal to the gas phase of step (i), (k) combining the multicomponent refrigerant streams of step (i) and step (j) for further cooling as performed in step (b) above.

2. The method of claim 1 wherein the non-hydrocarbon cooling fluid is water at ambient temperature.

3. The method of claim 1 wherein the single component refrigerant is selected from the group comprising propane and propylene.

4. The method of claim 1 or 3 wherein the multicomponent refrigerant is a mixture of nitrogen, methane, ethane and propane.

5. The method of claim 4 wherein the ethane or propane constituent of the multicomponent refrigerant is replaced with ethylene or propylene, respectively.

6. The method of claim 4 wherein the multicomponent refrigerant may also include butane or pentane.

7. The method of claim 1 wherein the non-hydrocarbon cooling fluid is air at ambient temperature.

* * * * *

UNITED STATES PATENT AND TRADEMARK OFFICE

CERTIFICATE OF CORRECTION

PATENT NO. : 4,404,008

DATED : September 13, 1983

INVENTOR(S) : Robert J. Rentler and David D. Sproul

It is certified that error appears in the above-identified patent and that said Letters Patent is hereby corrected as shown below:

Column 8, Line 29

Delete the phrase "series of" and delete the letter "s" from the word "exchangers"

Signed and Sealed this

*Twenty-eighth* Day of *May 1985*

[SEAL]

*Attest:*

DONALD J. QUIGG

*Attesting Officer* *Acting Commissioner of Patents and Trademarks*